United States Patent [19]

Lehn et al.

[11] 4,319,469

[45] Mar. 16, 1982

[54] PATTERN MECHANISM FOR A WARP KNITTING MACHINE

[75] Inventors: Rudolf Lehn, Bülach; Otto Hintsch, Wallisellen, both of Switzerland

[73] Assignee: Sulzer Brothers Ltd., Winterthur, Switzerland

[21] Appl. No.: 158,308

[22] Filed: Jun. 10, 1980

[30] Foreign Application Priority Data

Jun. 19, 1979 [CH] Switzerland ..... 5707/79

[51] Int. Cl.[3] ..... D04B 23/00

[52] U.S. Cl. ..... 66/207

[58] Field of Search ..... 66/203, 84, 204, 207

[56] References Cited

U.S. PATENT DOCUMENTS 4,139,997 2/1979 Riesen ..... 66/207

*Primary Examiner*—Ronald Feldbaum

*Attorney, Agent, or Firm*—Kenyon & Kenyon

[57] ABSTRACT

The pattern mechanism has a carrier member extending in the longitudinal direction of the tension elements for the guide bars. The carrier member supports pairs of final control elements for two tension elements. The pairs of final control elements are disposed in sets, e.g., of three, each provided with a common drive.

7 Claims, 2 Drawing Figures

PATTERN MECHANISM FOR A WARP KNITTING MACHINE

This invention relates to a pattern mechanism for a warp knitting machine. More particularly, this invention relates to a pattern mechanism for shogging guide bars of a warp knitting machine.

As is known, warp knitting machines have been constructed with various types of guide bars which are shogged from time-to-time in accordance with a programmed pattern via a pattern mechanism. One known pattern mechanism, such as described in U.S. Pat. No. 4,139,997, which is of the "additive" type, has employed final control elements in the form of eccentrics which are driven by a suitable drive to shog the guide bars via tension elements. Usually, each pattern mechanism is associated with one guide bar. Thus, if there are a multiplicity of guide bars or belts, the pattern mechanisms take up considerable space. Further, the drive for the individual final control elements is very complicated and access to the final control elements is very restricted. Thus, it has been difficult and time-consuming to adjust the individual final control elements for each guide bar.

Accordingly, it is an object of the invention to simplify the mounting of a drive for the final control elements of a pattern mechanism of the additive type in a warp knitting machine.

It is another object of the invention to make the final control elements of a pattern mechanism of a warp knitting machine accessible for adjustment.

Briefly, the invention provides a pattern mechanism for at least a pair of guide bars of a warp knitting machine which is comprised of a pair of tension elements, an elongated carrier member, rows of final control elements and a common drive.

The tension elements are each secured at one end to a respective guide bar while the carrier member extends between the two tension elements and is releasable from the drive.

The control elements are mounted on and along opposite sides of the carrier member to define pairs of interconnected control elements while the common drive includes a drive shaft connected to at least two pairs of interconnected control elements.

With this construction, the number of drive shafts for a plurality of final control elements is reduced. Since the carrier member is releasable from the drive shaft, the carrier member can easily be taken out and tensioned on a suitably-constructed assembly or adjusting frame on which the final control elements are freely accessible and can be adjusted.

Figure 1:
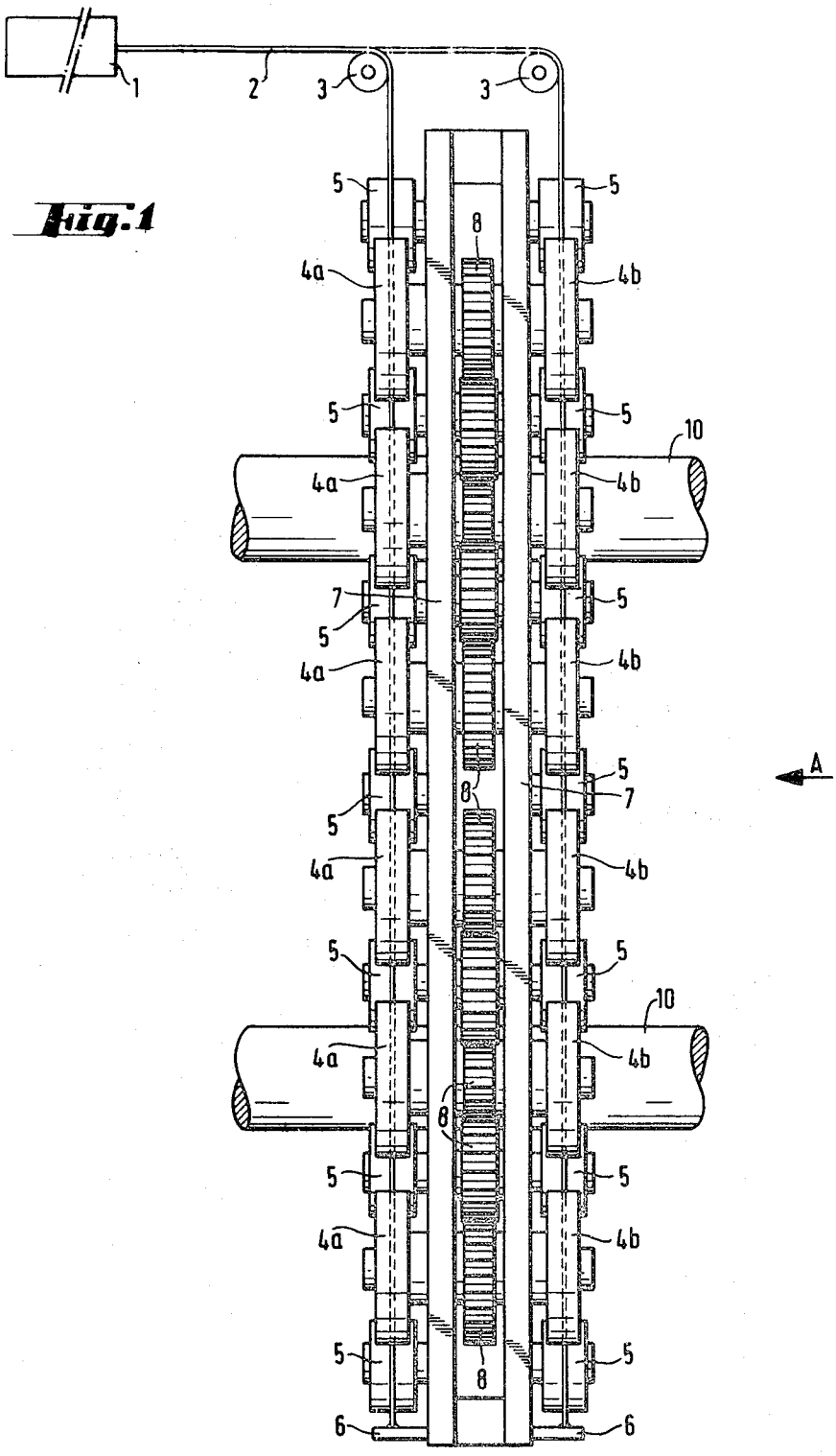
Figure 2A:
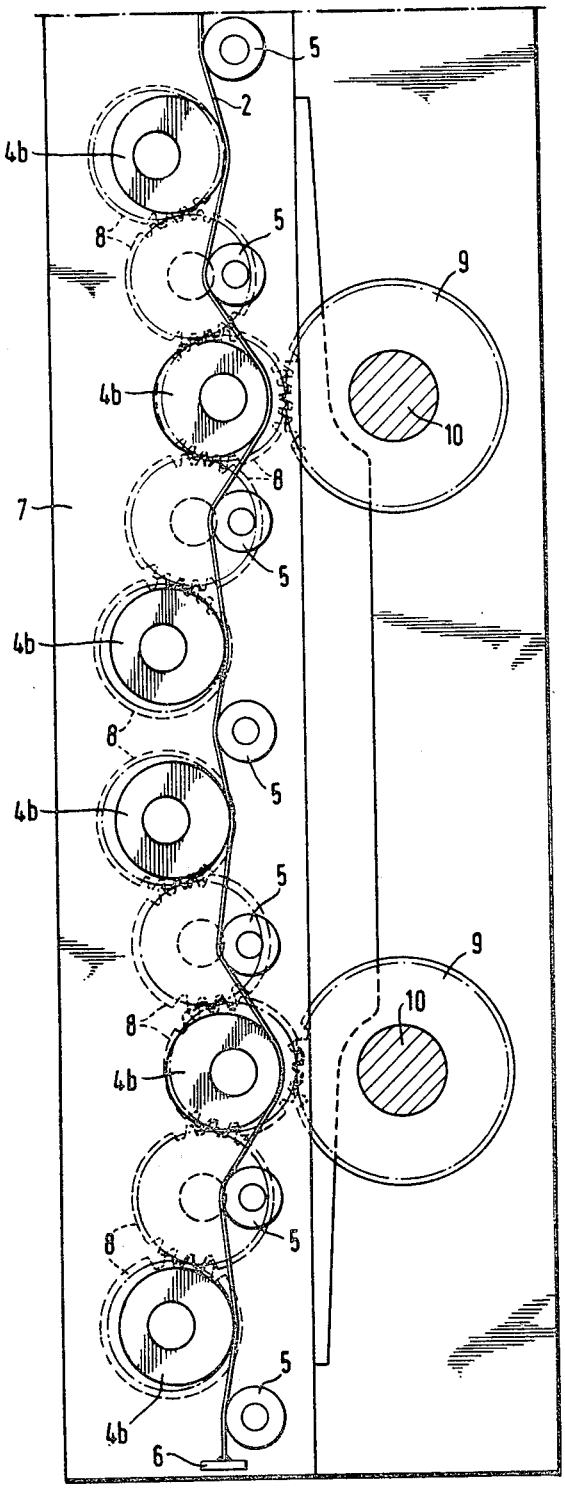

These and other objects and advantages of the invention will become more apparent from the following detailed description taken in conjunction with the accompanying drawings in which:

FIG. 1 illustrates a view of a pattern mechanism according to the invention; and FIG. 2 illustrates a view of the pattern mechanism taken in the direction indicated by the arrow A in FIG. 1.

Referring to FIG. 1, a warp knitting machine includes a plurality of guide bars 1 which are driven in a shogging direction from time-to-time. As indicated, pairs of guide bars are driven via a simple pattern mechanism off a common drive.

Each pattern mechanism includes a pair of tension elements 2, each of which is secured at one end to a respective guide bar 1 and which is guided over a guide pulley 3 and secured at the opposite end to an abutment 6. Each pattern mechanism also includes an elongated carrier member 7 of channel shape which extends between and along the tension elements 2 in parallel relation. This carrier member 7 has the abutments 6 mounted near one end in a suitable manner to anchor the tension elements 2.

A pair of rows of final control elements *4a, 4b*, constructed as eccentrics, as is known, are mounted on and along opposite sides of the carrier member 7 with each pair being interconnected via a stub shaft rotatably mounted in the walls of the carrier member 7. These control elements *4a, 4b* alternate with rollers 5 which are also mounted on and along the carrier member 7 to engage and adjustably deflect a respective tension element in known manner. The control elements *4a, 4b* also have dog clutches (not shown) for example, as described in German O.S. 27 41 200.

A plurality of gears 8 are also disposed in the pattern mechanism to connect the control element pairs to a common drive. As shown, a gear 8 (i.e., toothed wheel) is mounted on each stub shaft interconnecting two control elements *4a, 4b* between the legs of the carrier member 7 while a gear 8 is located between and meshes with two gears 8 of the interconnected pairs of control elements *4a, 4b*. The gears 8 and control elements *4a, 4b* are interconnected to form two sets of control elements on the carrier member 7.

The drive as constructed includes a pair of drive shafts 10, each of which carries a multiplicity of gears 9, only one of which is shown. Each gear 9 of a shaft 10 meshes with a central gear 8 of a control element set of a given pattern mechanism in order to impart a driving force to the control elements *4a, 4b* of the set simultaneously relative to the tension elements 2.

The carrier member 7 is mounted to be removed upwards or sideways, depending upon the position of the member, from the gears 9 on the shafts 10 and mounted separately in an adjusting frame. When in the adjusting frame, the final control elements *4a, 4b* are freely accessible and can be adjusted.

The invention thus provides a pattern mechanism in which the final control elements can be made readily accessible for adjustment in a relatively simple manner.

What is claimed is:

1. A pattern mechanism for at least a pair of guide bars of a warp knitting machine, said mechanism comprising:

a pair of tension elements, each said element being secured at one end to a respective guide bar;

an elongated carrier member extending between said tension elements;

a pair of rows of final control elements mounted on and along opposite sides of said carrier member to define pairs of interconnected final control elements; and a common drive connected to at least two pairs of interconnected control elements.

2. A pattern mechanism as set forth in claim 1 wherein said carrier member is releasable from said drive.

3. A pattern mechanism for a pair of guide bars of a warp knitting machine, said mechanism comprising:

a pair of elongated tension elements, each said element being connectable at one end to a respective guide bar;

an elongated carrier member extending along and between said tension elements;

a plurality of rollers mounted on and along opposite sides of said carrier member for guiding a respective tension element thereon;

a plurality of control elements mounted on and along opposite sides of said carrier member in alternating relation with at least some of said rollers to engage and adjustably deflect a respective tension element therebetween, said control elements being interconnected in pairs across said carrier member; and a common drive connected to at least two pairs of interconnected control elements for adjusting said two pairs of control elements simultaneously relative to said tension elements.

4. A pattern mechanism as set forth in claim 3 which further comprises a plurality of gears, each said gear being drivingly engaged between two pairs of interconnected control elements.

5. A pattern mechanism as set forth in claim 3 wherein said pairs of interconnected control elements are disposed in at least two sets, and which further comprises a pair of said drives, each said drive being connected to a respective one of said sets.

6. In combination, a plurality of guide bars of a warp knitting machine; and a pattern mechanism for said guide bars, said mechanism including a plurality of tension elements, each said element being connected at one end to a respective guide bar for shogging of said guide bar;

a plurality of carrier members, each said carrier member extending between and along a respective pair of said tension elements;

a plurality of final control elements mounted on opposite sides of each respective carrier member in interconnected pairs; and drive means for driving said control elements.

7. The combination as set forth in claim 6 wherein said drive means includes a pair of drive shafts and a plurality of gears on each drive shaft, each said gear being in driving engagement with at least two respective pairs of interconnected control elements on a respective carrier member.

* * * * *